US007780545B2

(12) United States Patent
Smith et al.

(10) Patent No.: US 7,780,545 B2
(45) Date of Patent: Aug. 24, 2010

(54) TRAINING SYSTEMS AND METHODS FOR ATHLETES

(75) Inventors: Fred W. Smith, Lake Forest, CA (US); Roland H. Wills, Mission Viejo, CA (US); Geoffrey N. Cornish, Laguna Hills, CA (US)

(73) Assignee: MCS Golf Company, LLC., Lake Forest, CA (US)

( * ) Notice: Subject to any disclaimer, the term of this patent is extended or adjusted under 35 U.S.C. 154(b) by 760 days.

(21) Appl. No.: 11/495,997

(22) Filed: Jul. 28, 2006

(65) Prior Publication Data

US 2007/0026369 A1 Feb. 1, 2007

Related U.S. Application Data

(60) Provisional application No. 60/703,726, filed on Jul. 29, 2005.

(51) Int. Cl.
*A63F 13/00* (2006.01)
*A63B 67/02* (2006.01)

(52) U.S. Cl. ..... 473/266; 473/207; 473/208; 473/220; 473/221; 473/234; 463/3; 463/7; 273/108.2; 273/245; 273/317.2; 434/252

(58) Field of Classification Search ..... 473/198, 473/207, 212, 213, 215, 231, 261, 266, 276, 473/422, 436, 453, 459, 461, 518, 131, 136, 473/140–141, 143, 145–146, 150–153, 156, 473/158, 160, 202, 204–217, 219–226, 234, 473/257, 280, 353, 405; 482/92, 94, 100, 482/103, 111, 112, 121, 139; 434/252; 463/2–3, 463/5, 7, 23, 30–32, 36–37, 42–43, 46–47, 463/50, 53, 56; 273/108.2, 108.21, 150, 273/245, 317.1, 317.2, 329–331, 359, 366–368, 273/406–408, 441, 444–446, 453, 460–461; 340/426.19, 539.13; 342/357.06, 357.08, 342/357.12; 701/213–215
See application file for complete search history.

(56) References Cited

U.S. PATENT DOCUMENTS

| | | | | | |
|---|---|---|---|---|---|
| 4,477,079 | A | * | 10/1984 | White | 473/221 |
| 5,067,717 | A | * | 11/1991 | Harlan et al. | 473/209 |
| 5,087,047 | A | * | 2/1992 | McConnell | 473/221 |
| 5,154,427 | A | * | 10/1992 | Harlan et al. | 473/218 |
| 5,282,628 | A | * | 2/1994 | Komori et al. | 473/136 |
| 5,467,992 | A | | 11/1995 | Harkness | |
| 5,599,239 | A | * | 2/1997 | Kim et al. | 473/208 |
| 5,634,855 | A | * | 6/1997 | King | 473/221 |
| 5,879,239 | A | * | 3/1999 | Macroglou | 473/209 |
| 5,926,780 | A | * | 7/1999 | Fox et al. | 702/142 |
| 6,261,189 | B1 | * | 7/2001 | Saville et al. | 473/221 |

(Continued)

OTHER PUBLICATIONS

International Search Report and Written Opinion of corresponding PCT Application No. PCT/US06/29705.

*Primary Examiner*—Peter DungBa Vo
*Assistant Examiner*—Arthur O. Hall
(74) *Attorney, Agent, or Firm*—Donald E. Stout; Stout, Uxa, Buyan & Mullins, LLP

(57) ABSTRACT

The system monitors a user's key physical movements when performing a particular activity, such as a golf swing, and signals visually and/or aurally when a single (or several) error(s) is/are committed, for the purpose of encouraging faster learning of fundamentally sound physical skills. Mental conditioning is achieved when the effects of repeatedly listening to the specially constructed and authored audio conditioning programs during practice sessions and games are combined with the above described physical monitoring effects of the system. Better physical execution of a selected technique or skill results, and the user experiences the benefits of mental conditioning on his/her playing performance.

18 Claims, 3 Drawing Sheets

U.S. PATENT DOCUMENTS 6,371,863 B1 * 4/2002 Moran ..... 473/207
6,431,991 B1 * 8/2002 Kossnar et al. ..... 473/216
6,612,937 B1 * 9/2003 Whelan ..... 473/268
6,730,047 B2 5/2004 Socci et al.
6,786,730 B2 * 9/2004 Bleckley et al. ..... 434/247
6,939,245 B1 * 9/2005 Mullarkey ..... 473/268
7,112,145 B2 * 9/2006 Gaddy ..... 473/220
2004/0005918 A1 * 1/2004 Walker et al. ..... 463/16
2006/0040757 A1 * 2/2006 Rosselli ..... 473/207
2007/0243942 A1 * 10/2007 Elliott ..... 473/220

* cited by examiner

| PLAYER 1 | CLUB/SHOT 2 | SWING THOUGHTS 3 |
|---|---|---|
| NICK FALDO | DRIVER | INTRODUCTION |
| IAN POULTER | FAIRW'Y WOOD | AIMING |
| FRED COUPLES | HYBRIDS | ADDRESS |
| | LONG IRONS | BACKSWING |
| | MID IRONS | TRANSITION |
| | HIGH IRONS | DOWN & THROUGH |
| | WEDGE SHOTS | IMPACT THOUGHTS |
| | CHIPPING | THROUGH TO TARGET |
| | BUNKER PLAY | FINISHING BALANCED |
| | PUTTING | TIPS FOR LENGTH etc. |

34

TRAINING SYSTEMS AND METHODS FOR ATHLETES

This application claims the benefit under 35 U.S.C. 119(e) of the filing date of Provisional U.S. Application Ser. No. 60/703,726, entitled Golfer Training System, and filed on Jul. 29, 2005, which application is expressly incorporated herein by reference.

BACKGROUND OF THE INVENTION

Many who have developed a "love-hate" relationship with the game of golf would agree with the statement that golf is, by far, the most difficult sport in the world to master. The sport involves striking the smallest, hardest ball of any sport with the longest (relative to ball size) sports implement and the smallest club-head surface area. The right club must be selected from a bag of fourteen different implements, for shots of greatly varying distances over uneven playing surfaces and a variety of obstacles and terrain.

Because of these great challenges, golf is a game requiring both physical and metal conditioning, and imaging technique development. All successful players accept this as fact. Yet the mental conditioning part of the game has not been taught in definitive and concrete processes, using specifically evolved techniques and specifically developed product technologies and processes until now.

One of the most common mistakes of a golfer is his/her tendency to lift the head in order to follow the flight of the ball. It is important that the head remain down, focusing on the target, until after the ball has been struck. What is needed are new, effective, and fresh techniques for reinforcing the concept of keeping one's head down during the entire golf swing.

SUMMARY OF THE INVENTION

The present invention comprises a system which monitors a user's key physical movements and signals visually and/or aurally when a single (or several) error(s) is/are committed, for the purpose of encouraging faster learning of fundamentally sound physical skills, without a coach being present. Mental conditioning is achieved when the effects of repeatedly listening to the specially constructed and authored audio conditioning programs during practice sessions and games are combined with the above described physical monitoring effects of the system. Better physical execution of a selected technique or skill results, and the user experiences the benefits of mental conditioning on his/her playing performance.

The inventive system comprises several interactive sensor and switching control functions located on a ground-based rectangular track unit. This track unit works together with a remote controlled headset/earpiece audio device, which utilizes suitable communications technology, such as Bluetooth™ technology, to receive unit functional instructions (manual or voice activated). The headset/earpiece also emits an infrared beam to communicate with the ground-based, or portable, switching unit.

The headset device houses an audio and digital signal receiver, an audio speaker, a digital audio program data storage device, and a related driver device. The driver device interactively responds to player or coach-initiated manually voice-activated instructions to replay the stored or wirelessly received instructions and mental imaging related programs, menus, units or subcomponents thereof.

A movable sensor unit slides down a track, enabling the golfer to constantly hit balls from grass (or a mat or tee position) and simultaneously continue to, via infra-red sensing technology or other suitable technology, connect the headset and earpiece functions without moving the base ground unit. This permits the golfer to continue to practice and gradually acquire the pre-determined technique. The movable sensor unit houses a digital display clock and several sets of LED lights.

Advantageously, the disclosed technology permits the player to remain mentally aware of his/her actions in connection with swinging towards a target through usage of the device. It also enables the player to take up the correct shot address, stance, or position, and disciplines, teaches, and simplifies the process of the player addressing the ball and simultaneously aiming prior to making a swing. Additionally, it provides a guide to the golfer's mental image of the required swing path as it relates to his/her alignment and execution of the technique being learned.

Adjustable functions and features are provided, which personalize the inventive device to a user's own preferences. These features permit him/her to focus on making clear specific incremental physical and mental improvements in learning component parts, and also provide mental thoughts to guide him/her through the development of the skill or technique he/she has pre-selected to learn. These adjustable and selectable functions and features are:

a) swing rhythm (lights and/or audio signals) for regulating the speed relationship between the club takeaway and downswing (swing tempo);

b) swing address timing (visual digital display of a countdown clock);

c) head movement, wherein sensors cause the actuation of an audio and/or visual signal where pre-set or allowed side-to-side and up and down distances/tolerances are exceeded by the player;

d) a sensor that detects a ball placed in hitting position (audio/visual signal); and e) an infrared beam or other suitable sensing technology from the headset/earpiece can be directionally adjusted within limitations to connect with a sensor on the ground unit.

Resetting each of the adjustable functional aspects of the device features in relation to each other enables the user to investigate which settings work best for him or her. The player can increase or decrease specific settings which, in turn, changes the demands that the device places on the user for physical accuracy and mental discipline in the performance of specific techniques on a progressive basis. This adjustability encourages the user to progressively learn tighter or looser conformity to various different aspects of the required physical disciplines and mental approach, consequently developing more accurate muscle memory by repetition. The player can experiment to find the best settings for his/her own personal comfort and learn at which settings his/her performance is best by statistical analysis of the results from his/her swings at different settings.

Operation of the device's adjustable and switching functions can be both manually executed and/or by voice-activation technology depending on the design of the particular device being used for the application or sport.

Together with the particular features, described above, by which the user can improve his/her practice techniques and swing mechanics, the inventive concept also provides for the delivery of audio "swing thoughts" to the user. This feature provides the advantage of motivating the user to think of the mental aspects of his/her game instead of only concentrating solely on mechanics and swing technique.

More particularly, there is provided a system for improving the skills of a user in a particular activity, preferably a repeatable activity such as a golf swing, which comprises a base unit comprising a housing and an actuator in the base unit for initiating an operating cycle of the base unit. An emitter is adapted for disposition on the body of the user, preferably the head. A sensor on the base unit is provided for communicating with the emitter along a line-of-sight. An alarm indicates to the user when contact has been broken between the sensor and the emitter.

Preferably, the actuator comprises a ball detection sensor for sensing the presence of a ball in a ball placement zone, but may also comprise a manual switch or the like. The emitter comprises a portion of a headband, or a portion of an earpiece or headphones. The alarm preferably comprises an audible alarm received by the user through the earpiece or headphones, but may alternatively or also comprise a visual alarm emanating from the unit, and even an audible alarm emanating from the base unit.

An indicator on the base unit, preferably a light, is actuated when the operating cycle is initiated. A second indicator, also preferably a light, is actuated when the base unit sensor and the emitter establish sensor contact. The system additionally preferably comprises a timing cycle control.

Another advantageous feature of the invention is that the base unit preferably comprises a track portion on which the housing is disposed. The housing is movable along said track portion, to easily adapt to different positions taken by the user as he/she practices the particular activity.

Still another advantageous feature of the present invention is the provision of an audio programming system in the base unit for transmitting selected audio programming to the user through the earpiece or headphones. This audio programming may comprise messages from professional golfers or the like, related to mental aspects of the activity being performed, for example.

In another aspect of the invention, there is provided a system for improving the skills of a user in a particular activity, which comprises a base unit for providing feedback to the user regarding his/her activity mechanics, as well as an audio programming unit for transmitting audible messages related to the particular activity to the user. The base unit preferably further comprises a sensor on the base unit and an emitter adapted for disposition on a portion of the body of the user, preferably the head, wherein the feedback comprises a message provided to the user when sensor contact is broken between the sensor and the emitter.

A controller is preferably provided for permitting the user to select, from a menu, the particular audible messages to be transmitted by the audio programming unit. The audio programming unit comprises an audio module having a flash memory for storing an audio program downloaded from a particular source and a micro-controller, said audio module is capable of communication with hardware adapted for transmitting portions of the audio program to the user, which hardware is preferably disposed on the base unit.

In still another aspect of the present invention, there is disclosed a method of training in order to improve in the performance of a particular repeatable activity. The method comprises steps of placing an emitter on a portion of the body of a user, preferably the head, and sensing the presence of a ball in a predetermined ball placement zone in order to initiate an operating cycle of a base unit. The body of a user is then placed in position to conduct the particular activity, after which contact is established between the emitter and a sensor on the base unit while in the aforementioned position. The particular activity, preferably a golf swing, is conducted and an alarm is provided if contact is broken between the emitter and the sensor during the activity. In a unique aspect of the inventive method, predetermined audible messages may be transmitted to the user during the particular activity.

In order to gauge improvement, a further step of incrementing a counter may be performed if the particular activity is conducted without breaking sensor contact between the emitter and the sensor. The user will thus be able to determine how many times the activity is repeated, sequentially, without breaking sensor contact. When contact is broken during a particular activity cycle, the counter is reset to zero.

In yet another aspect of the invention, there is disclosed a method of conducting a program for training users in conducting a particular activity. The method comprises steps of creating suitable audio programming comprising messages related to different aspects of the particular activity, preferably a golf swing, encrypting the audio programming, and downloading the audio programming to an authorized memory device. The authorized memory device may then be connected to a device which is capable of decrypting and playing the audio programming.

The audio programming is periodically updated, and the updates are available for download to users from whom periodic subscription fees are collected.

The training method further comprises a step of simultaneously providing feedback to the user as the user practices the particular activity, while listening to the audio programming. The feedback comprises a visual or audible alarm transmitted to the user if contact is broken between a sensor on a base unit and an emitter on the user while the user is conducting the particular activity.

The invention, together with additional features and advantages thereof, may be best understood by reference to the following description taken in conjunction with the accompanying illustrative drawings. In these accompanying drawings, like reference numerals designate like parts throughout the figures.

DETAILED DESCRIPTION OF THE INVENTION

Figure 1:
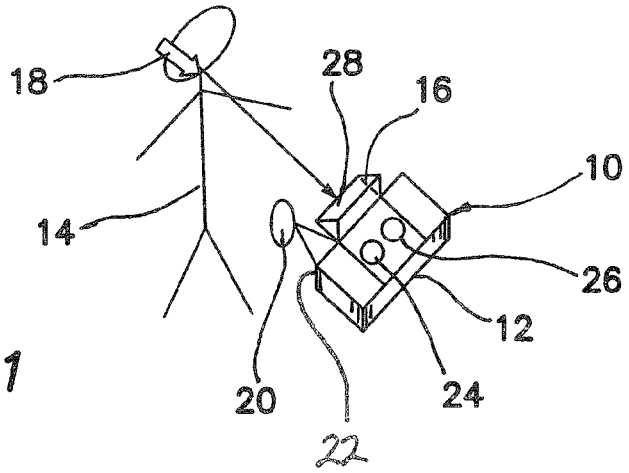
FIG. 1 is a schematic view illustrating a preferred embodiment and method for the present invention.
Figures 3, 6:
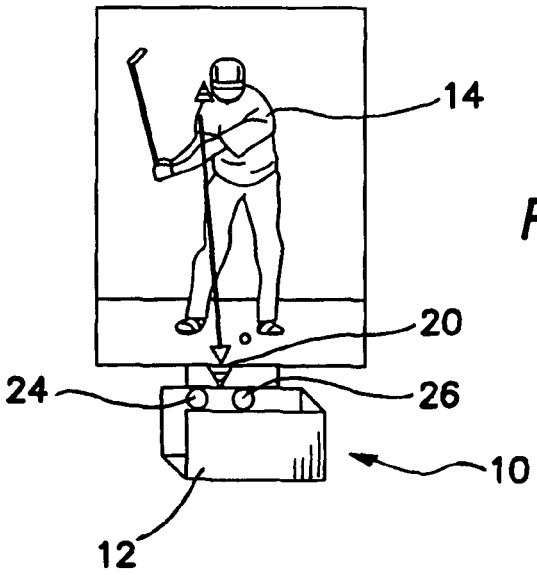
FIG. 3 is a view of a person using one embodiment of the present invention.
FIG. 6 is a matrix illustrating various options for using the audio module for the present invention.

Referring now more particularly to the drawings, there is shown in FIGS. 1 and 3 a preferably portable ground-based sensor unit or base unit 10 constructed in accordance with the principles of the invention. The base unit 10 comprises a housing 12 which may be either portable or permanently stationed. It may be powered using batteries, or by plugging the unit into an electrical outlet, as desired. The base unit 10 is positioned so that a golfer 14 preparing to swing at a golf ball stands in front of the unit as shown in FIGS. 1 and 3. Typically, the setting will be a golf driving range or other location where the golfer can actually strike a golf ball, but it could also be in a training location, including indoors, where the golfer simulates striking the golf ball or hits a plastic practice ball. A suitable sensor 16 is disposed on a front side of the unit 10, facing the golfer 14, which is preferably an infrared sensor. The golfer 14 wears an emitter device 18 which communicates along a line of sight with the sensor 16. In a preferred embodiment, the emitter 18 is part of a headband or small earpiece transmitter. One example of a type of sensor/emitter system which could be employed in the invention is disclosed in U.S. Pat. No. 6,730,047 to Socci et al., which is herein expressly incorporated by reference.

As the golfer 14 is preparing to swing, a golf ball is placed in a desired location within a ball placement zone 20 in front of a ball detection sensor 22, which may also comprise an infrared sensor, of a similar type as is employed as the above described sensor 16. More particularly, the ball detection sensor 22 is a transmitter/receiver pair matched in frequency. Of course, each of the sensors 16 and 22 may alternatively comprise any other sensor known in the art or which will be known in the future for performing the described functions. Once the ball detection sensor 22 detects the presence of a ball within the ball placement zone 20, a "ball indicator" light 24, or other suitable visual or aural indicator, is actuated to let the golfer 14 know that the system has detected the ball, and the operating cycle has been initiated. A "golfer ready" indicator light 26, or other suitable visual or aural indicator, is actuated when the sensor 16 detects a beam emitted by the emitter 18, indicating that the golfer is in his/her setup position and is properly positioned to begin his/her swing.

In operation, as noted above, the golfer 14 places a ball in the ball placement zone 20 to indicate to the unit 10 an intention of hitting. At the same time, the golfer takes his/her set-up stance and tilts his/her head to look at the ball. At this point, the ball detection sensor 22 detects the ball in the ball placement zone 20 and initiates a microcontroller in the unit 10, which in turn starts a counter within the unit 10. Once the ball is detected, the unit controller will expect a signal from the emitter 18 on the golfer's head within a predetermined time limit. When the sensor 16 detects a signal from the emitter 18, both the ball indicator light 24 and the "golfer ready" indicator light 26 are actuated.

Once both of the indicators 24 and 26 are actuated, the system is adapted so that the ball must be hit by the golfer's club before the golfer moves his/her head sufficiently that the contact between sensor 16 and emitter 18 is broken. If sensor/emitter contact is broken, it is an indication that the golfer improperly over-rotated his/her head during the swing. This will cause suitable alarms to be actuated to alert the golfer of his/her error. A visual alarm, together with other desired information, may be displayed on a screen 28 visible to the golfer from the striking position. This visual alarm may be informational, or a series of flashing lights, or the like. Additionally, or alternatively, an audible alarm may be sounded in the earpiece 18 of the golfer, and/or on the unit 10 itself.

Even when contact between sensor 16 and emitter 18 is being maintained during the golfer's swing, the inventive system provides for the option of displaying on screen 28 various messages, such as reminders, tips, encouragement, etc. In one favored embodiment, a set of messages flash on the display 28 in steady rhythm, to subconsciously assist the golfer's swing tempo. Suitable repeatedly flashed messages may include "SWING EASY" and "HEAD DOWN".

A visible unit swing counter, on the display screen 28, displays the number of successful swings the golfer has completed without breaking sensor contact between sensor 16 and emitter 18. As noted above, a counter increments every time a ball is detected in the ball placement zone 20. The counter resets to zero when a swing is attempted during which the golfer's head turns sufficiently to break sensor contact. The counter function provides feedback to the golfer concerning whether he/she is improving, and also allows for competitive fun as golfers can compete against themselves or other golfers to see how many successful swings they can execute in a row.

Figure 4:
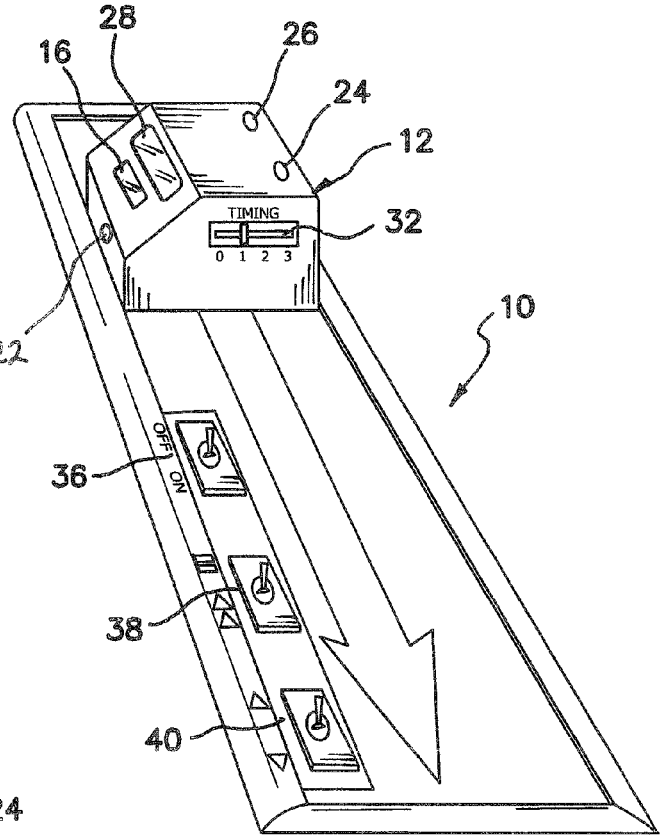
FIG. 4 is a perspective view of a presently preferred embodiment of a portable ground module for use with the present invention, in a first configuration.
Figure 5:
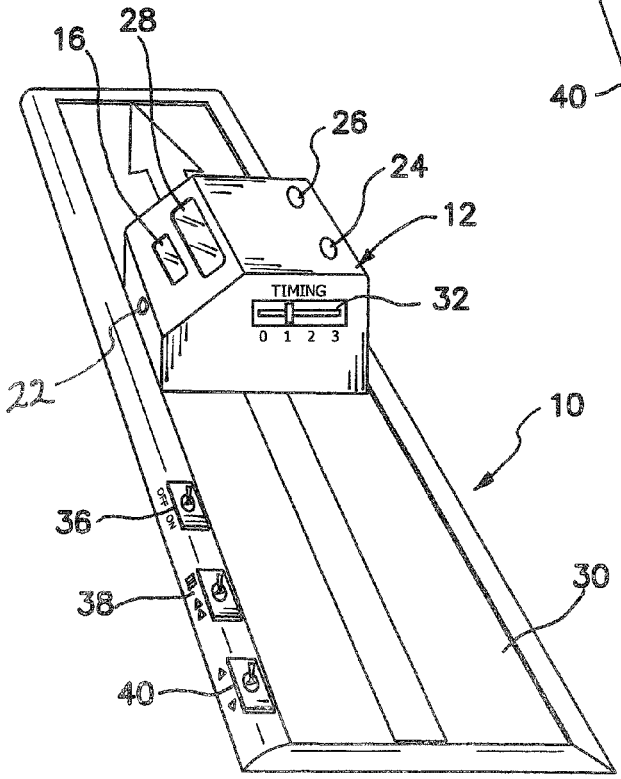
FIG. 5 is a view similar to FIG. 4 illustrating the portable ground module in a second configuration.

Now with reference to FIGS. 4 and 5, a modified and presently preferred embodiment of the portable base unit 10 is shown. This unit is similar to that described in connection with FIGS. 1 and 3, but incorporates additional advantageous features and functions. The device 10 comprises an elongated track portion 30 on which is mounted the housing 12. Advantageously, the track 30 can be positioned adjacent to a golfer location, as in FIGS. 1 and 3, and then the housing 12 can be further positioned along the track 30, by moving the housing 12 along the track, as shown, in order to adapt the location of the unit for different types of shots (e. g. short iron shots where the ball is placed back in the stance or woods shots where the ball is placed forward in the stance) without the necessity of relocating the entire unit 10. FIGS. 4 and 5 are substantially identical, except that in FIG. 4 the housing 12 has been moved to a distal location along the track 30 and in FIG. 5 the housing has been moved to a more proximal location along the track 30. It is within the scope of the present invention for the housing 12 to be motorized for movement along the track 30, or, alternatively, to be movable manually by the golfer as desired. Typically, in order to reduce costs, the housing is manually movable along the track 30 and includes convenient apertures so that the golfer may merely insert his/her golf club into the aperture to effect the desired movement. The housing 12 may be mounted on bearings, castors, wheels, or the like, for facilitating movement along the track 30.

Like reference numerals in the embodiment of FIGS. 4 and 5, to those in the embodiment of FIGS. 1 and 3 denote like elements with equivalent functions as described above, and will not be further described herein. An additional feature of the present invention is a timing control 32 for permitting the golfer to set a time interval in intervals of seconds. The timer provides for a digital display with a countdown function. The golfer can see the actual time he/she took to strike the ball. The display will also indicate, by stopping the countdown timer, the point when the golfer moved his/her head sufficiently so that contact was lost between the sensor 16 and emitter 18, causing an alarm, as described above. The timer automatically resets to the selected time by the golfer within a preset time after the ball is hit or the golfer's head moves before the ball is hit. Another feature of the timer is to limit the time the golfer has to strike the ball to a predetermined period, set by the golfer, in countdown mode, after which the unit deactivates if the ball has not been struck. In such an instance, the ball must be removed and placed again in the ball placement zone in order to activate the unit. An advantage of this feature is to discipline the golfer to develop a more timely swing pattern.

The present invention has an additional feature in that it is capable of receiving and playing back audio programming designed to assist the golfer as he/she is practicing his/her swing. A representative menu 34 for this audio programming is illustrated in FIG. 6. Three different controls are provided for utilizing this feature, which has been identified by the inventors as a "Swing Thoughts" feature. Control switch 36 permits the user to select a particular professional player as listed in the first column of the audio menu 34 of FIG. 6 if desired. Control switch 38 permits the user to select audio appropriate to the type of shot he/she wishes to practice, as shown in the second column of the audio menu 34 of FIG. 6. Control switch 40 permits the user to select audio related to the portion of the swing the golfer wishes to work on, as shown in the third column of the audio menu 34 of FIG. 6. Of course, these features are variable, and the menu items identified in each of the three menu columns are variable. In general, audio instructions help the users to mentally picture or envision how to correctly perform a particular skill, or component parts thereof, from a remote, ground-based, or personally worn audio program delivery storage and interactive switching unit.

There is also nothing critical about the choice of three different menu columns or control switches. There could be more or fewer selections, and the means of selection could be different. Rather than the illustrated toggle switches on the track portion 30, a wireless control unit could be used, or any other suitable selection means.

Figure 2:
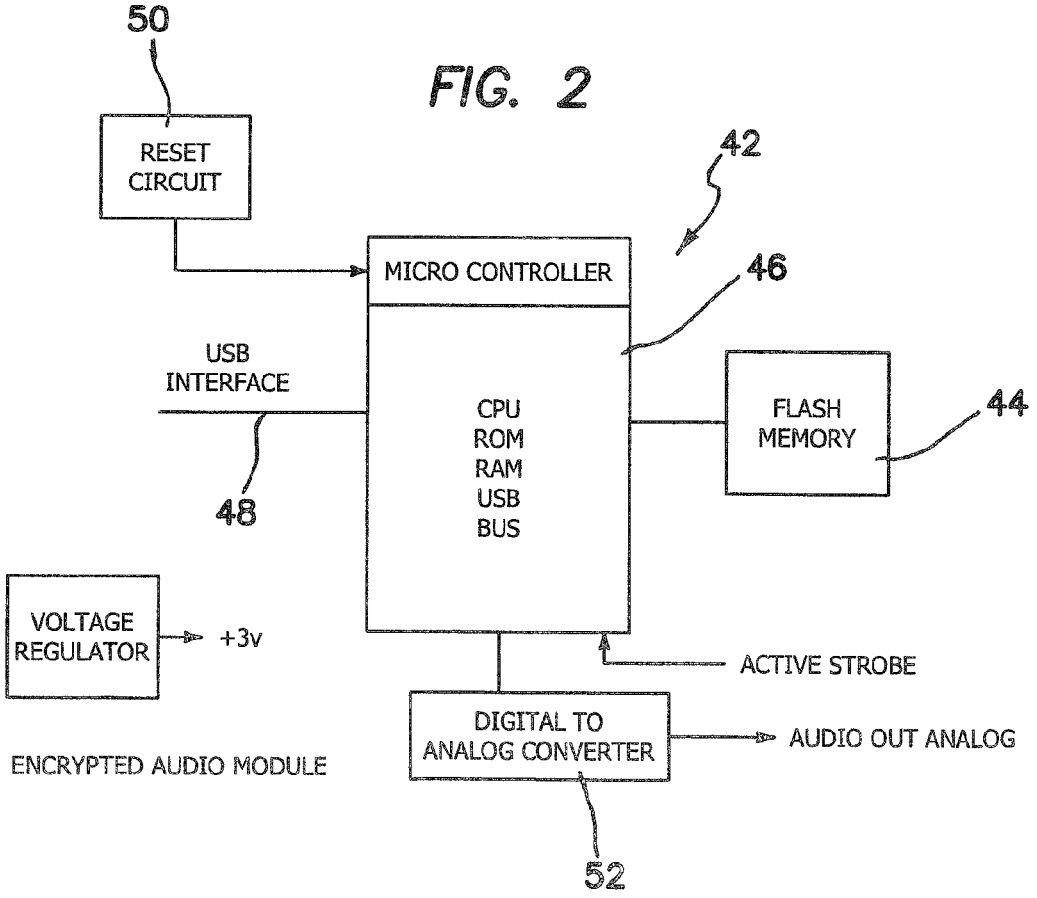
FIG. 2 is a schematic view of an audio module for use in the present invention.

In FIG. 2 there is schematically illustrated a presently preferred embodiment of an audio module 42 constructed in accordance with the principles of the present invention. The inventive concept is that a web site is operated which provides suitable audio programming for use with the inventive system. The web site makes available to those accessing the site, upon authorization, the current audio programming for download. The user downloads the audio programming onto their personal computer or other memory device, and, ultimately, the flash memory 44 in the audio module 42. The audio module 42 is then inserted into a suitable port on the base unit 10 so that the current audio programming may be downloaded onto the base unit 10 for use by the golfer.

More particularly, in one presently preferred embodiment, a subscriber to the inventive system will be provided with a host personal computer program which may be utilized to acquire the above described audio programming from the aforementioned supported website. A periodic subscription to the website is offered because the audio programming is regularly updated, by adding additional professional golfers, tips, philosophies, and the like, all designed to assist the golfer in improving his game and his enjoyment of the game. The currently downloaded audio programming may be downloaded directly onto the flash memory 44 of the audio module 42, via a USB 2.0 port or other suitable technology, or it may be downloaded onto an alternative memory device (such as the PC's internal hard drive) and then transferred onto the flash memory 44. Typically, the audio file is an encrypted compressed file, so that it is only playable on an authorized device. The module 42 may be plugged into a suitable port on the device 10 in order to permit the device 10 to utilize the audio programming contained therein. The module 42 is adapted for decrypting the audio file for direct audio play. The hardware module, when inserted into the target equipment, will play upon demand of an internal control signal.

More particularly, the audio module 42 includes a micro controller 46, a USB interface 48, a reset circuit 50, and a Digital-to-Analog Converter 52. The hardware module preferably comprises audio file playback, USB support, 3-DES decryption (192 bit encryption), key management, and error management.

The PC host software, mentioned above, includes a device driver for hardware USB interface, a DLL software component for device management, and a V-basic program comprising USB download management, FTP transfer of the file from the website, a secure billing information handler, and website audio selection.

The complete audio program menu (APM) of units (APU's) or any number of pre-selected audio program units may be delivered to the user in any desired sequence or in a predetermined order in several technologically sophisticated ways. For example, as noted above, they can be downloaded from the Internet, and stored in an audio module 42. They can alternatively be stored in a data carrier/player, such as an MP3 player, owned and operated by the user, or from a static, remote, or portable personally carried device. Another option is to deliver the program wirelessly from a digital player or from the Internet to multiple players simultaneously via a private local area voice netwoar available only to those who wear headset devices capable of receiving the broadcast program. Still another option is to deliver the programs wirelessly from an instructor speaking specifically to an individual or group of individuals during a training or new skill acquisition session.

Other optional features of the present invention include an ability, with appropriate sensors, to detect club head angle as the club head passes through the ball placement zone, and to convey a suitable message on the display screen 28 to the golfer regarding the detected angle. Additionally, sensors may be employed which enable the golfer to know, via appropriate display, how far behind the ball the club head struck the ground, to encourage striking down on the ball, rather than hitting the ball fat.

In the event that a user wishes to use the inventive unit without actually striking a ball (indoors, for example), an optional feature is an actuator which the user can initiate for simulating the detection of a ball in the ball placement zone to initiate operation of the device.

While the aforementioned inventive systems and methods are disclosed, in presently preferred embodiments, as being related to the sport of golf, it will be appreciated by those skilled in the art that the inventive concepts taught herein are equally applicable, with suitable adaptation, to any number of other sports, such as, for example, tennis, baseball, basketball, squash, skiing, and many others.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A system for improving the skills of a user in a particular activity, comprising:

a base unit comprising a housing and a track portion on which said housing is disposed, said housing being movable along said track portion;

a first sensor in said base unit configured to sense the presence of a ball in a ball placement zone adjacent to said base unit, and to initiate an operating cycle of the base unit;

an emitter configured to be disposed on the body of the user;

a second sensor on said base unit configured to communicate with said emitter along a line-of-sight; and an alarm configured to indicate to the user when contact has been broken between said sensor and said emitter.

2. The system as recited in claim 1, wherein said emitter comprises a portion of a headband.

3. The system as recited in claim 1, wherein said emitter comprises a portion of an earpiece or headphones.

4. The system as recited in claim 3, and further comprising an audio programming system in said base unit which is configured to transmit selected audio programming to the user through said earpiece or headphones.

5. The system as recited in claim 1, wherein said alarm comprises an audible alarm received by the user through said earpiece or headphones.

6. The system as recited in claim 1, wherein said alarm comprises one or both of a visual and an audible alarm.

7. The system as recited in claim 1, and further comprising an indicator on said base unit which is actuated when said operating cycle is initiated.

8. The system as recited in claim 7, and further comprising a second indicator on said base unit which is actuated when said base unit sensor and said emitter establish sensor contact.

9. The system as recited in claim 1, and further comprising a timing cycle control on said base unit.

10. The system as recited in claim 1, wherein said particular activity comprises the action of swinging a golf club.

11. A method of training in order to improve in the performance of a particular repeatable activity, comprising:

placing an emitter on a portion of the body of a user;

moving a housing of a base unit along a track portion of the base unit to a desired location adjacent to a predetermined ball placement zone;

sensing the presence of a ball in the predetermined ball placement zone, using a first sensor on the housing, in order to initiate an operating cycle of the base unit;

placing the body of a user in position to conduct the particular activity, and establishing contact between said emitter and a second sensor on the base unit while in said position;

conducting the particular activity; and providing an alarm if contact is broken between the emitter and the second sensor during the activity.

12. The method as recited in claim 11, and further comprising a step of transmitting predetermined audible messages to the user during the particular activity.

13. The method as recited in claim 11, wherein the particular activity comprises swinging a golf club.

14. The method as recited in claim 11, and further comprising a step of incrementing a counter if the particular activity is conducted without breaking sensor contact between the emitter and the second sensor.

15. The method as recited in claim 11, wherein the emitter is placed on the head of the user.

16. The method as recited in claim 11, and further comprising:

creating suitable audio programming comprising messages related to different aspects of the particular activity;

encrypting the audio programming;

downloading the audio programming to an authorized memory device; and connecting the authorized memory device to a device which is configured to decrypt and play the audio programming.

17. A system for improving the skills of a user in a particular activity, comprising:

a base unit comprising a housing and a track portion on which said housing is disposed, said housing being movable along said track portion;

an actuator in said base unit configured to initiate an operating cycle of the base unit;

an emitter configured to be disposed on the body of the user;

a sensor on said base unit configured to communicate with said emitter along a line-of-sight; and an alarm configured to indicate to the user when contact has been broken between said sensor and said emitter.

18. The system as recited in claim 17, wherein said particular activity comprises the action of swinging a golf club.

* * * * *